US008075351B2

(12) United States Patent
Park et al.

(10) Patent No.: US 8,075,351 B2
(45) Date of Patent: Dec. 13, 2011

(54) ELECTRICAL CONNECTOR AND CONNECTOR ASSEMBLY

(75) Inventors: Joo Hyun Park, Gyeonggi-do (KR); Jae Han Jeong, Gyeonggi-do (KR)

(73) Assignee: FCI Automotive Holding, Guyancourt (FR)

( * ) Notice: Subject to any disclaimer, the term of this patent is extended or adjusted under 35 U.S.C. 154(b) by 0 days.

(21) Appl. No.: 12/312,620

(22) PCT Filed: Nov. 20, 2007

(86) PCT No.: PCT/IB2007/055390

§ 371 (c)(1),
(2), (4) Date: Dec. 28, 2009

(87) PCT Pub. No.: WO2008/062389

PCT Pub. Date: May 29, 2008

(65) Prior Publication Data

US 2010/0105254 A1 Apr. 29, 2010

(30) Foreign Application Priority Data

Nov. 20, 2006 (KR) ..... 10-2006-0114779

(51) Int. Cl.
*H01R 13/514* (2006.01)

(52) U.S. Cl. ..... 439/752; 439/372

(58) Field of Classification Search ..... 439/599, 439/686, 695, 701, 595, 752, 372
See application file for complete search history.

(56) References Cited

U.S. PATENT DOCUMENTS 5,928,038 A 7/1999 Berg et al. ..... 439/752
6,305,990 B1 * 10/2001 Ward ..... 439/752

FOREIGN PATENT DOCUMENTS

KR 1020020095891 A 12/2002

* cited by examiner

*Primary Examiner* — Ross Gushi
(74) *Attorney, Agent, or Firm* — Harrington & Smith

(57) ABSTRACT

The present invention relates to an electrical connector, which comprises means for preventing terminals from being deformed during connection of the connector. The electrical connector of the present invention comprises: a terminal position assuring member mounted to a connector housing; and a terminal protecting plate mounted to the terminal position assuring member. The terminal protecting plate comprises a first engaging element and the terminal position assuring member comprises a second engaging compactly configured since there is no need to provide any means for mounting or retaining the terminal protecting plate to the connector housing.

20 Claims, 9 Drawing Sheets

ELECTRICAL CONNECTOR AND CONNECTOR ASSEMBLY

This application claims priority from Republic of Korea patent application number 10-2006-114779, filed on 20 Nov. 2006, entitled "Electrical Connector And Connector Assembly", which is hereby incorporated for reference.

TECHNICAL FIELD

The present invention relates to an electrical connector, and particularly relates to an electrical connector that is employed in connecting an electrical system to a central control unit of a vehicle, etc.

BACKGROUND

Generally, an electrical connection apparatus, which is conventionally known as a connector, is installed at a portion of an electrical system for transmitting power source, electrical signal or information, and connects two separated wires. Such a connector configured for connecting two separated wires comprises female and male connectors, wherein female or male terminals are provided inside of each connector such that the female and male terminals contact each other, thereby achieving electrical connections. Such an electrical connecting method employing a connector is employed for connection between circuit boards or elements in various electrical products.

Recently, various electrical device components for more comfortable and safe driving are employed in motor vehicles, which require a number of electrical wirings for the components. Such a number of electrical wirings are disposed at each part of a vehicle in the form of a wire harness for compact design and easy assembling of the vehicle. A wire harness, which is a coated bundle of several individually insulated wires, is used for electrically-connecting and linking each part of a vehicle. Such wire harnesses are positioned at every part of a vehicle with each end thereof being engaged with a connector, and an electrical connection can be achieved by connecting one connector with another connector. As an example of a wiring configuration of the interior of a vehicle employing wire harnesses, the wire harnesses include conductive wires pulled out from a control unit of a vehicle and a connector is provided at one end portion of the wire harnesses, and the corresponding connector to be engaged with said connector may be installed at the interior of a vehicle.

When engaging the connector that is engaged to one end of the wire harnesses with the corresponding connector that is installed at an electrical device component of a vehicle, a skilled person faces much difficulty in such an engagement process as these connectors should be installed within a limited space, e.g., the engine room of a vehicle. For more convenient engagement process of connectors, it has been known in the art that connectors are slightly fitted and then completely engaged to each other by operating an engagement support mechanism, such as a lever or a slider, which is installed at one side of the connectors.

However, since a conventional support mechanism is already in a completely engaged state when conveyed to a work place, a skilled person must disassemble the engagement support mechanism before engaging connectors, which adds more complexity to the process. Further, after the completion of the engagement by the support mechanism, any carelessness in work procedures may cause the support mechanism to come off from its original position. Moreover, when wiring conductive wires that are bound to the corresponding connector installed at an electrical device component, if a skilled person stretches the conductive wires for precise wiring, this may cause harm to the binding part, thereby causing damage to a connector.

In addition, in the prior art, a housing is configured to comprise both a terminal position assuring member assuring the precise position of the terminal and a receiving portion for receiving a protection plate protecting the terminal, thus it is inevitable that the size of the housing becomes large, and thereby increasing the volume of the connector assembly.

SUMMARY OF THE INVENTION

To overcome the above drawbacks, the present invention aims at providing an electrical connector and connector assembly, which are capable of facilitating the locking and disconnecting of the assembly at every step of the assembling process.

Further, it is another objective of the present invention to provide a compact electrical connector and connector assembly, since a connector housing has a simple and compact design, which does not require a means for mounting or retaining a terminal protecting plate, thereby minimizing the volume of the assembly.

According to the preferred embodiment of the present invention, an electrical connector comprises a housing having a plurality of male terminals and a number of terminal receiving holes for receiving and supporting the male terminals therein; a first terminal position assuring member mounted to the housing, the terminal position assuring member including a plurality of first terminal passing holes configured so that one end of the terminals passes therethrough; engaging means; and a terminal protecting plate mounted to the terminal position assuring member by the engaging means, the terminal protecting plate including second terminal passing holes aligned with the first terminal passing holes.

Said engaging means consist of a first engaging element disposed in said terminal protection plate and a second engaging element disposed in said terminal position assuring member and being complementarily engaged with said first engaging element. Said first engaging element comprises a plurality of first engaging legs extending from said terminal protection plate; one or more first recess portions formed on the first engaging legs, wherein said second engaging element comprises a supporting leg and one or more first protrusion portions laterally protruding from said supporting legs and engaged to said first recess portion.

Said first engaging element comprises a plurality of first engaging legs, extending from said terminal protection plate and one or more first protrusion portions laterally protruding from said first engaging legs, wherein said second engaging element comprises a supporting leg and one or more first recess portions engaged to said first protrusion portion.

It is preferable that said first engaging element and said second engaging element are elastically engaged to each other.

Further, said housing includes a third engaging element disposed at opposing sides of said housing, wherein said terminal position assuring member includes a fourth engaging element engaged to said third engaging elements.

Said third engaging element comprises a first insertion portion formed along the longitudinal direction of said terminal receiving holes, and one or more second protrusion portions protruding from an inner wall of said first insertion portion, wherein said fourth engaging element comprises a second engaging leg inserted into said first insertion portion and one or more second recess portions formed on said second engaging leg and being elastically engaged to said second protrusion portion.

Said third engaging element further comprises second and third insertion portions, formed in a longitudinal direction of said terminal receiving holes, wherein said second engaging element comprises a leg receiving portion inserted into said second insertion portion, wherein said first engaging element comprises a third engaging leg engaged to said leg receiving portion; and a guide leg inserted into said third insertion portion.

Furthermore, said terminal position assuring member further includes a kojiri preventing wall formed to be higher than one end of said terminal, wherein said terminal protection plate further includes a through hole, through which the kojiri preventing wall passes.

The connector assembly according to the preferred embodiment of the invention includes a male connector and a female connector matable to each other. Said male connector comprises a male connector housing having a plurality of male terminals; a number of male terminal receiving holes for receiving and supporting the terminals therein; a connector receiving portion at a side, in which one end of the male terminals are projected, for receiving the female connector; and engagement pins respectively formed on inner opposite surfaces of the connector receiving portion.

Said female connector comprises a female connector housing, which can be inserted into the connector receiving portion, the female connector housing having a plurality of female terminals for connection to the male terminals and a plurality of female terminal receiving holes for receiving and supporting the female terminals therein; a second terminal position assuring member mounted to an end portion of the female connector housing to be inserted into the connector receiving portion, the second terminal position assuring member having a hexahedral shape opened at a top side and having through holes aligned with the female terminal receiving holes at a bottom side; and a lever member pivotably mounted to the female connector housing and having a receiving groove for receiving the engagement pin during engagement of the connectors and applying force to said engagement pin by pivoting, the force being required to engage and separate said male connector and female connector.

It is preferable that said second terminal position assuring member comprises a lever stopper for fixing said lever member with respect to said female connector housing.

DETAILED DESCRIPTION OF THE PREFERRED EMBODIMENTS

Hereinafter, with reference to FIG. 1-9, various embodiments of an electrical connector according to the present invention will be described in details.

Figure 1:
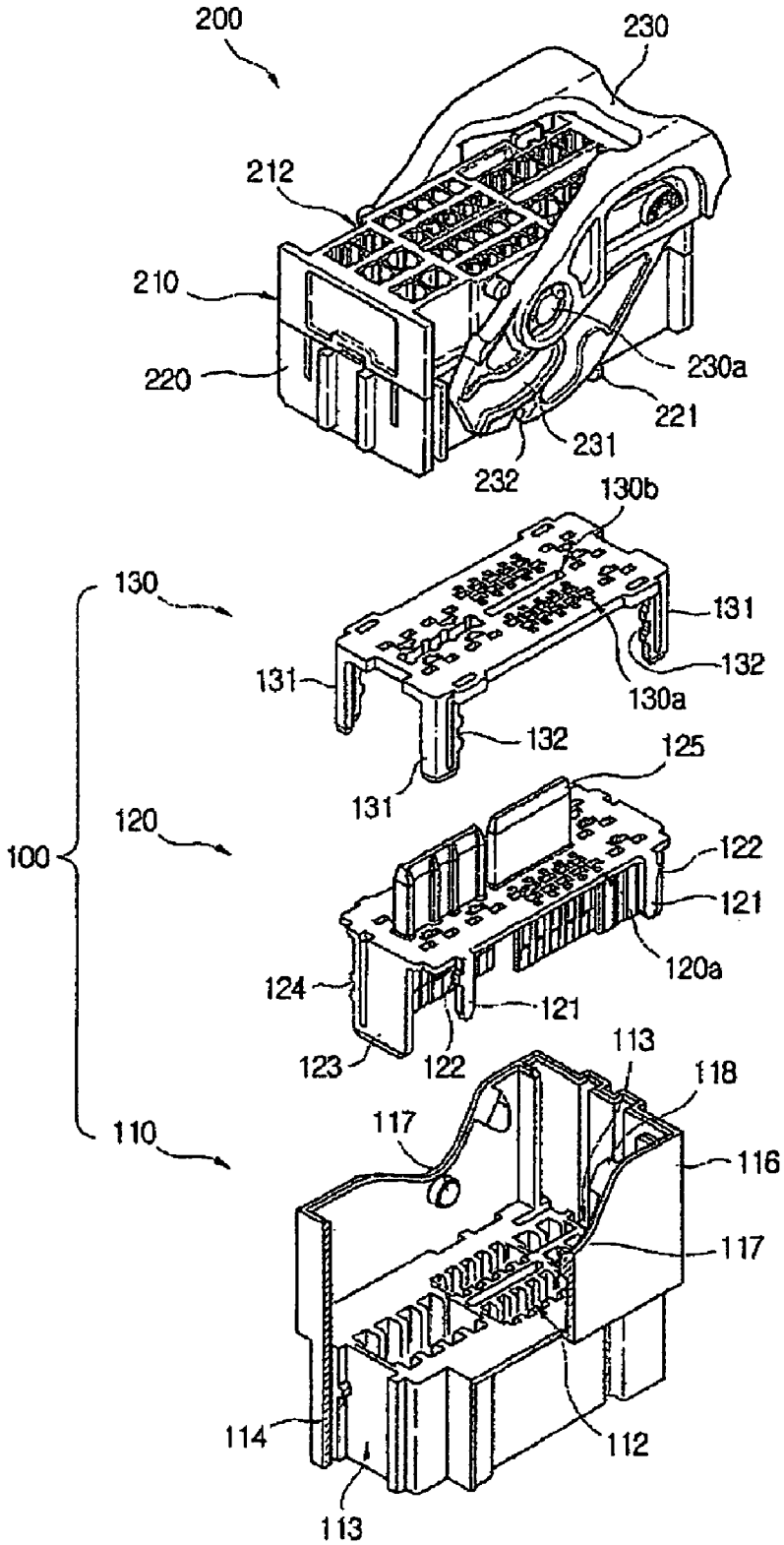
FIG. 1 is an exploded-perspective view showing a connector assembly according to the first embodiment of the present invention.

FIG. 1 is an exploded-perspective view showing a connector assembly according to the first embodiment of the present invention. The connector assembly includes a male connector (100) and a female connector (200) matable to each other.

The male connector of said connector assembly comprises a housing (110) having a plurality of male terminals and a number of terminal receiving holes (112) for receiving and supporting the male terminals therein; a terminal position assuring member (TPA: Terminal Position Assurance) (120) mounted to the housing (110), the terminal position assuring member including a plurality of first terminal passing holes (120*a*) configured so that one end (111*a*) of said terminals (111) passes therethrough; engaging means; and a terminal protecting plate (130) mounted to the terminal position assuring member (120) by said engaging means, the terminal protecting plate including second terminal passing holes (130*a*) aligned with said first terminal passing holes (120*a*).

The housing (110) of said male connector (100) comprises a connector receiving portion (116) for receiving the female connector (200), the connector receiving portion formed at a side, in which one end of the male terminals are projected; and engagement pins (117) respectively formed on opposite inner surfaces of said connector receiving portion (116).

Meanwhile, the female connector (200) comprises a female connector housing (210), which can be inserted into said connector receiving portion (116), the female connector housing having a plurality of female terminals for connection to the male terminals (111, 311) of said male connector (100) and a plurality of female terminal receiving holes (212) for receiving and supporting the female terminals therein; a second terminal position assuring member (220) mounted to an end portion of the female connector housing (210) to be inserted into the connector receiving portion (116), the second terminal position assuring member having a hexahedral shape opened at a top side and having through holes at a bottom side aligned with the female terminal receiving holes (212); and a lever member (230, 430) pivotably mounted to said female connector housing (210) and having an engagement pin receiving groove (231) for receiving the engagement pin (117) during engagement with the connectors and applying force to said engagement pin (117) by pivoting, the force being required to engage and separate said male connector (100) and female connector (200). That is, the male terminal of a pin shape is inserted and fixed to the male terminal receiving holes (112) of said male connector (100) and the female terminal of a shape corresponding to that of the male terminal is installed at an inner surface of the female terminal receiving holes (212) of said female connector (200), so that the female connector (100) and the male connector (200) mate to each other, thereby inserting said male terminal into said female terminal and achieving electrical connection.

Figure 2:
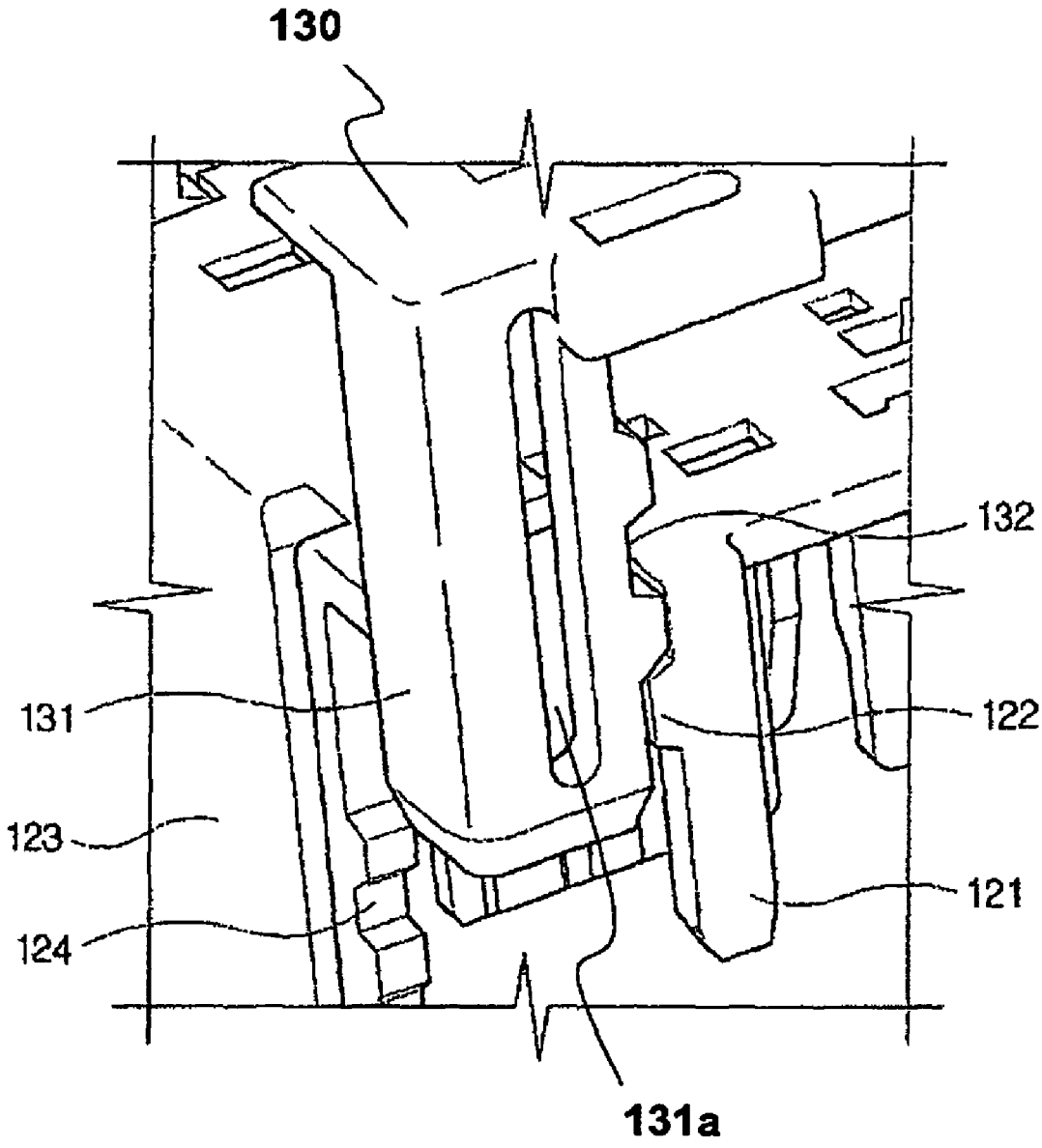
FIG. 2 is an enlarged-perspective view showing an engaged condition of engaging means of an electrical connector according to the first embodiment of the present invention.

As shown in FIG. 2, according to the present preferred embodiment of the invention, said engaging means comprise a first engaging element disposed in said terminal protection plate (130), and a second engaging element disposed in said terminal position assuring member (120) and complementarily engaged with said first engaging element, and the terminal protection plate (130) and the terminal position assuring member (120) are engaged to each other by the engagement made between the first engaging element and the second engaging element. At this time, said first engaging element comprises a plurality of first engaging legs (131) extending from said terminal protection plate (130), and the first recess portions (132) formed at said first engaging legs (131), wherein said second engaging element comprises supporting legs (121) and one or more first protrusion portions (122) laterally protruding from said supporting legs (121) and engaged to said first recess portions (132). Each of the four corners of the terminal protection plate (130) and terminal position assuring member (120) is formed with said engaging legs (131) and supporting legs (121), respectively. In this preferred embodiment of the invention, the first recess portions (132) are formed at the first engaging legs (131), and the first protrusion portions (122) are formed at the supporting legs (121), or conversely the recess portions may be formed at the supporting legs (121) and the protrusion portions may be formed at the first engaging legs (131).

Said housing (110) includes a third engaging element disposed in opposing sides of said housing, and said terminal position assuring member (120) includes a fourth engaging element, which is engaged to the third engaging element, whereby the engagement made between the third engaging element and the fourth engaging element allows the housing (110) to be engaged to the position assuring member (120). Said third engaging element comprises a first insertion portion (113) formed along a longitudinal direction of the terminal receiving holes (112), and one or more second protrusion portions (114) protruding from an inner wall of the first insertion portion, wherein said fourth engaging element comprises second engaging legs (123) inserted into the first insertion portion, and one or more second recess portions (124) formed on the second engaging legs (123) and elastically engaged to the second protrusion portions (114). That is, the third engaging element and the fourth engaging element are engaged in the same way that the first engaging element and the second engaging element are engaged.

Further, it is preferable that at least one or both of the first engaging legs (131) of the first engaging element and the supporting legs (121), and at least one or both of the second engaging legs (123) and the inner wall of the case forming the first insertion portions (113) are elastically made since it facilitates assembling and disassembling of the assembly. As illustrated in FIG. 2, a space (131*a*) is formed in the middle of the first engaging legs (131) so as to facilitate such an elastic engagement, whereby the range of elastic deformation enlarges.

Figure 3:
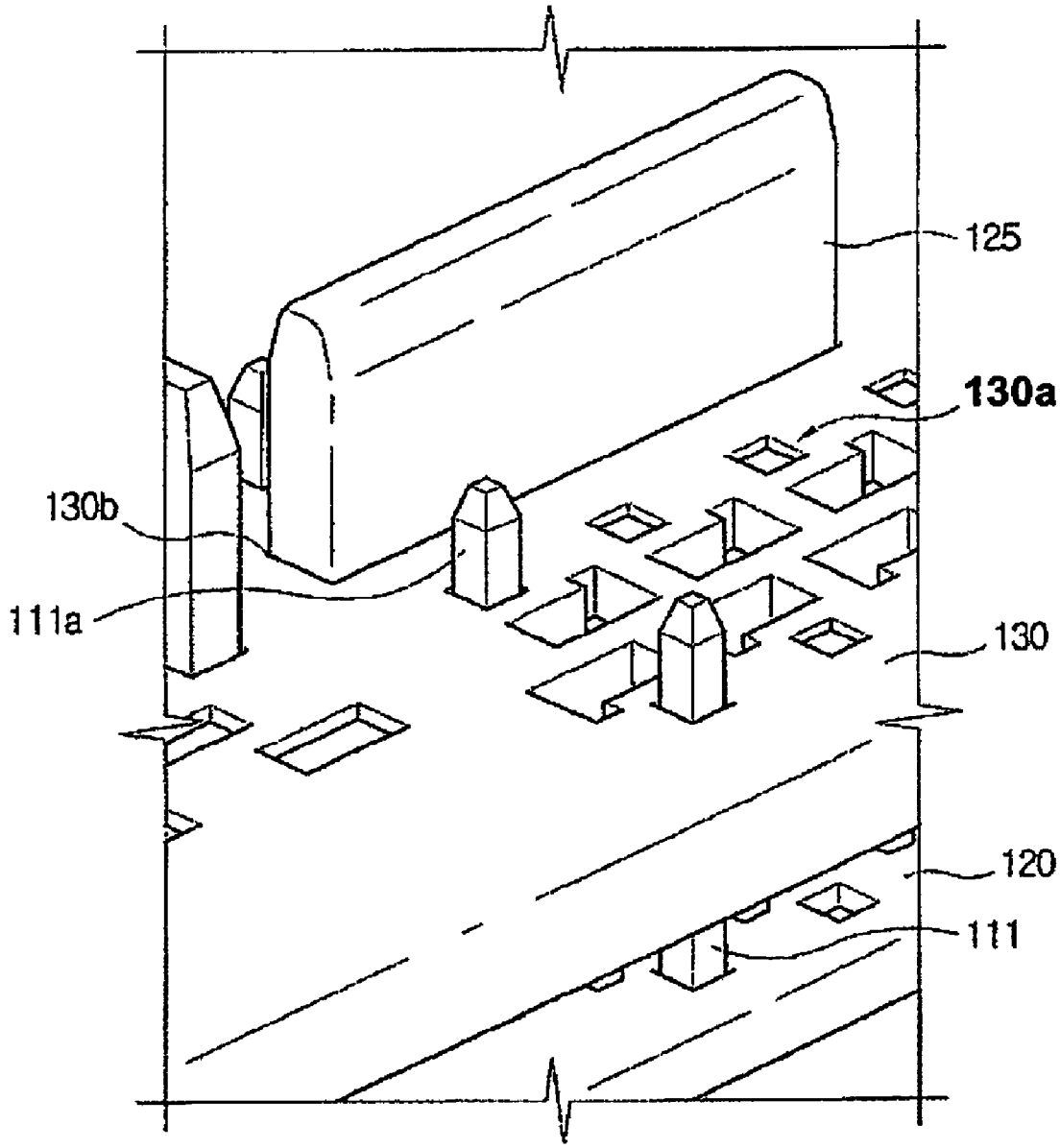
FIG. 3 illustrates a kojiri preventing wall of an electrical connector according to the first embodiment of the present invention.

FIG. 3 is a perspective view showing the structure of the kojiri preventing wall of the electrical connector. "Kojiri" means a protecting member formed around the inlet of a scabbard in order to prevent the blade of the knife from being damaged by the inlet of the scabbard when the knife is inserted into the scabbard unparallel. The term, kojiri preventing wall, used throughout the specification, indicates a wall member for protecting male terminals (111) formed inside the housing of the male connectors in order to prevent the male terminals from being bent, deformed, or damaged when the ends of the male terminals fail to be inserted in female terminals and contact the structure of the female connector (200) if the female connector (200) has been slantingly inserted into the connector receiving portion (116) of the female connector (100).

As illustrated in FIG. 3, the terminal position assuring member (120) of the male connector (100) in the embodiment further includes the kojiri preventing wall (125) formed higher than one end of the terminals, and the terminal protecting plate (130) further includes through holes (130*b*), which the kojiri preventing wall (125) passes through, whereby the female connector (200) first touches the kojiri preventing wall (125) formed higher than the male terminals (111) when the female connector (200) is slantingly inserted, and thus, even if the male terminals (111) do not fit in the female terminals, the male terminals (111) can be prevented from being bent or damaged in advance. Further, the terminal protecting plate also guides the female terminals of the female connector (200) to meet the male terminals without failing so that the male terminal can be inserted in parallel into the female terminal.

Hereinafter, the second embodiment of the electrical connector assembly according to the present invention will be described, with reference to FIGS. 4 and 5. The number of terminals of the connector of said FIG. 1 is 34, but the second embodiment describes the connector having more number of terminals, i.e., 48 terminals. The terminal protecting plate (330) has a thin and long shape. Thus, as the number of terminals increases and the size of the connector becomes larger, the deflection of the middle part of the terminal protecting plate (330) becomes greater. Since such a deformation cannot be ignored, the embodiment forms engaging means at both sides of the middle part, which becomes greatly deformed, rather than at the corners.

Figure 4:
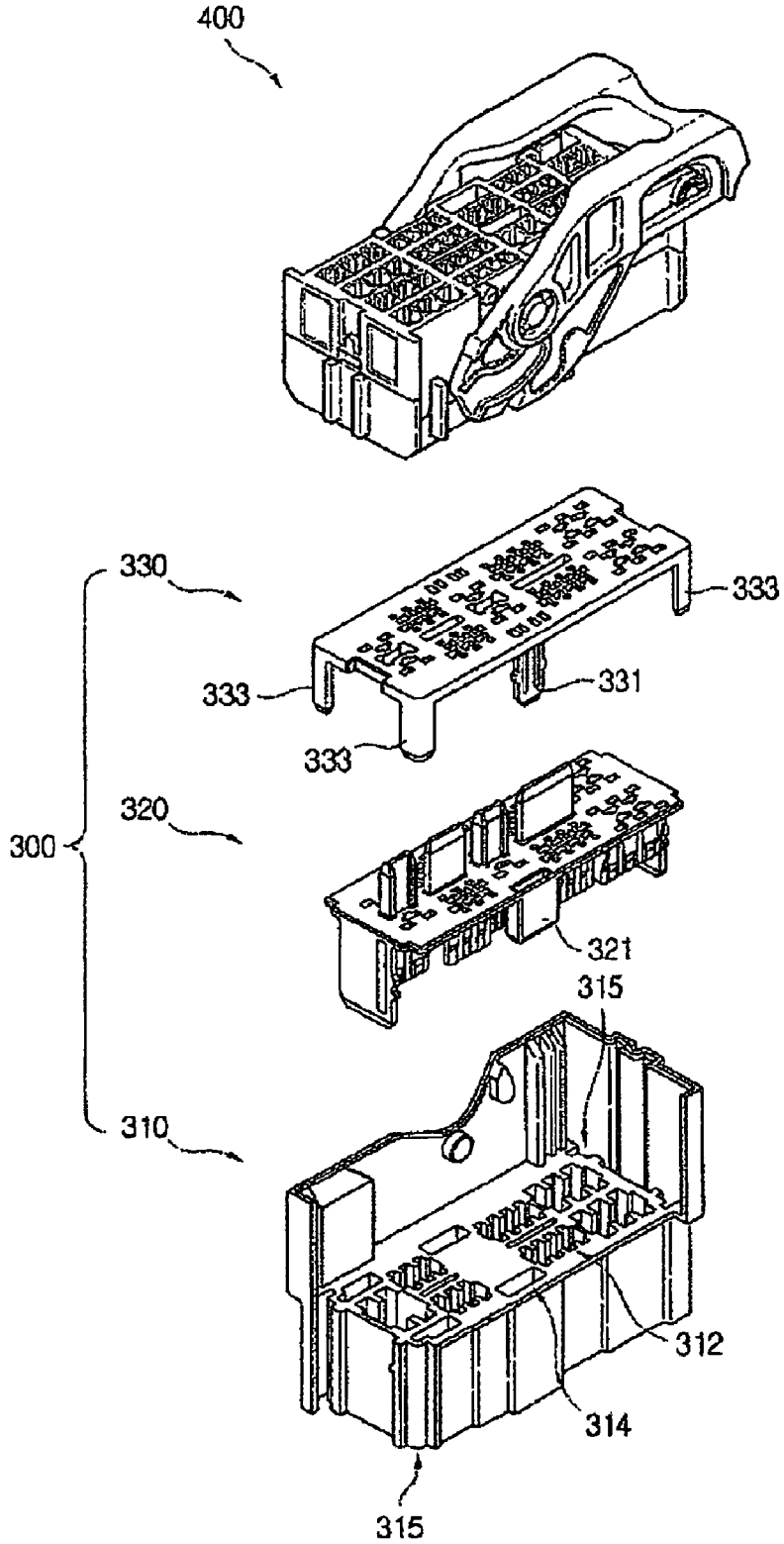
FIG. 4 is an exploded-perspective view showing a connector assembly according to the second embodiment of the present invention.

As shown in FIG. 4, in the embodiment, the engaging means further comprise the second and the third insertion portions (314, 315) formed along a longitudinal direction of the terminal receiving holes (312) as the third engaging element formed at the male connector housing (310); a leg receiving portion (321) inserted into the second insertion portion (314) as the second engaging element formed at the terminal position assuring member (320); and a guide leg (333) inserted into the third insertion portion (315) and the third engaging leg (331) engaged to the leg receiving portion (321) as the first engaging element formed at the terminal protecting plate (330). Meanwhile, the third engaging element and the fourth engaging element for engaging the terminal position assuring member (320) and the housing (310) of the male connector (300) will not be described in detail, since they are identical to the embodiment of FIG. 1. Meanwhile, the female connector (400) is similar to the female connector (200) of FIG. 1, except for the female terminal receiving groove and the number of female terminals.

Figure 5:
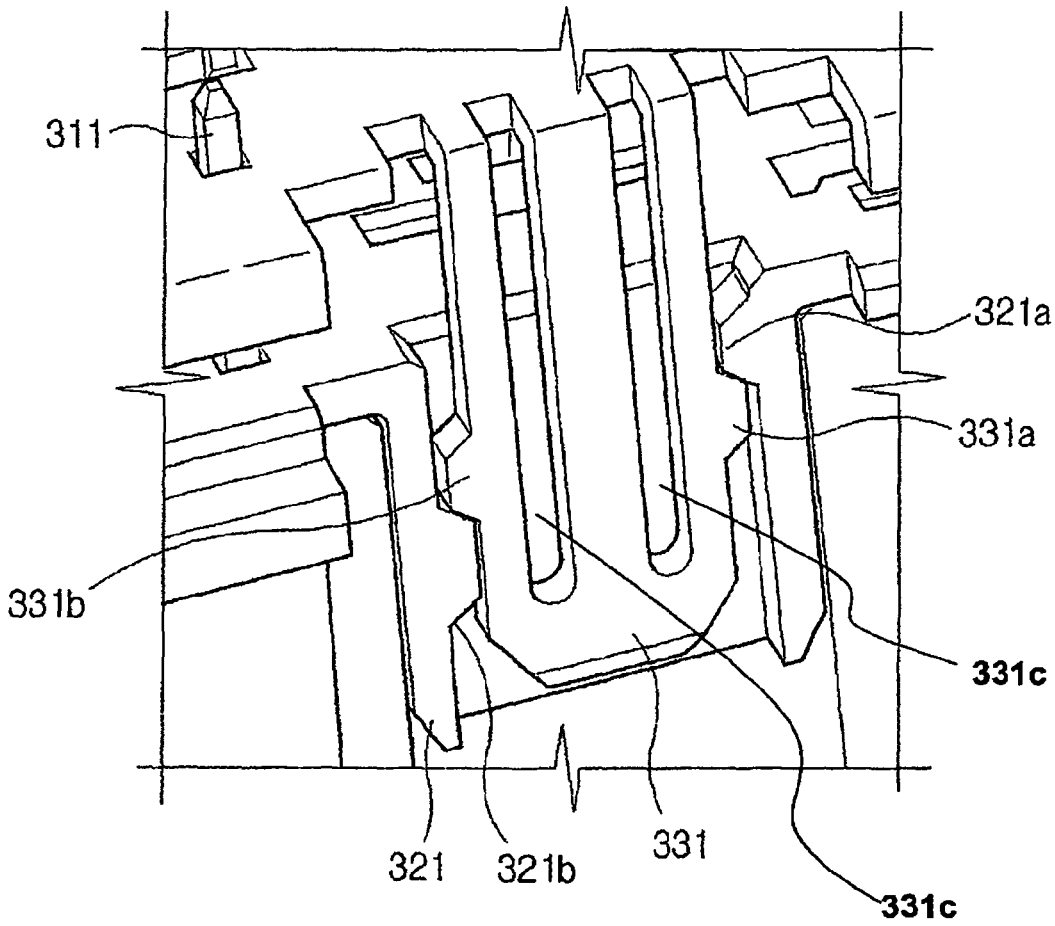
FIG. 5 is an enlarged view showing an engaged condition of engaging means of an electrical connector according to the second embodiment of the present invention.

As shown in FIG. 5, in order to engage the leg receiving portion (321) with the third engaging leg (331), the third engaging leg (331) is provide with one or more third engaging protrusions (331*a*, 331*b*), and the leg receiving portion (321) is provided with receiving protrusions (321*a*, 321*b*) that receive one or more third engaging protrusions (331*a*, 331*b*) for engagement. In FIG. 5, the receiving protrusions (321*a*, 321*b*) are formed with different heights, so that the two third engaging protrusions (331*a*, 331*b*) protruding from both sides of the third engaging leg (331) are received and engaged to the receiving protrusions in a stepwise manner. That is, in order to facilitate the work in the wire harness working stage, an engaging structure is formed so that only one of the third engaging protrusions is engaged with the receiving protrusion (321*a*) when the connector case is transmitted for the wire harness work, as shown in FIG. 5, and the remaining third engaging protrusions (331*b*) are engaged at the corresponding receiving protrusions (321*b*) by the operator when the wire harness work has been finished. The third engaging leg (331) is provided with one or more slots (331*c*) in the middle in order to facilitate the elastic engagement.

Figure 6:
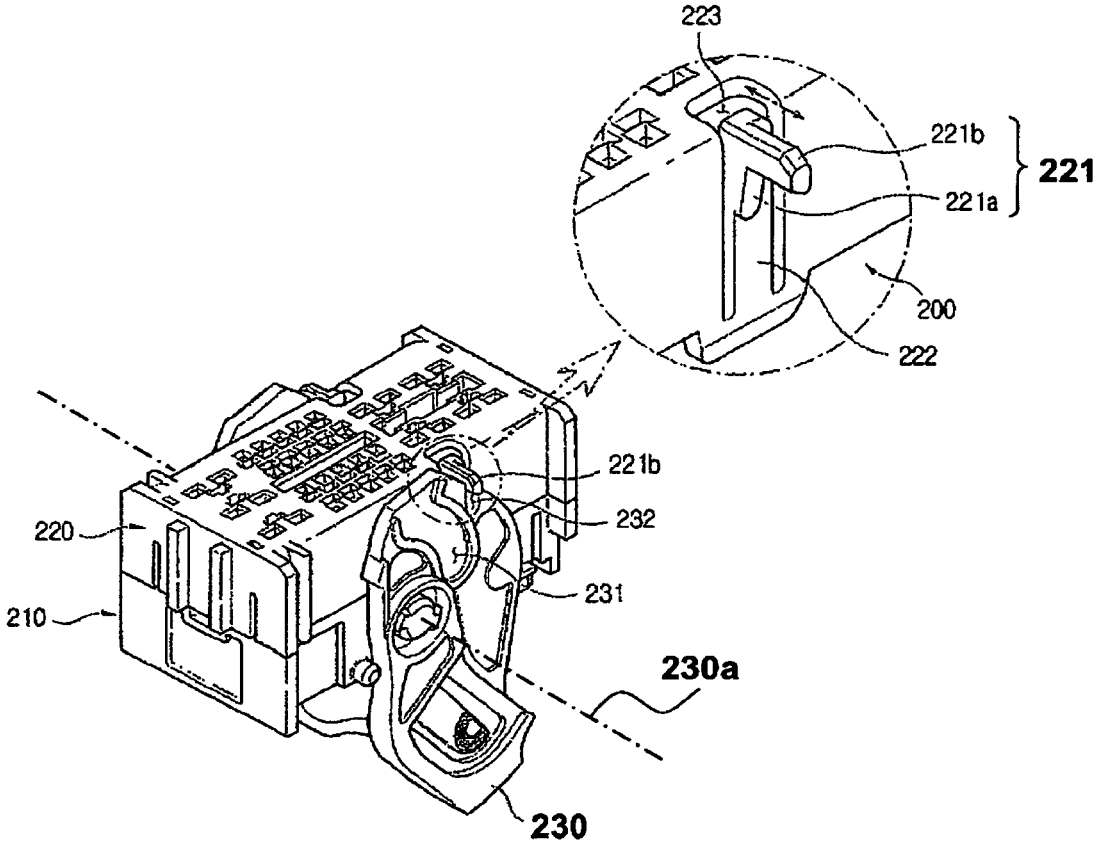
FIG. 6 is a perspective view showing a lever fixing structure of the electrical connector according to the present invention.

FIG. 6 illustrates an embodiment of a female connector. As shown in FIG. 6, the lever member (230) of the female connector (200) is pulled back so that the female terminals are inserted into the female terminal receiving portion (212). During this operation, since a fixing means is required to prevent the lever member (230) from moving, the second terminal position assuring member (220) is provided with a lever stopper (221) as a fixing means for fixing the lever member (230) to the female connector housing (210). The lever stopper (221) is made from an elastic material. The lever member (230) is provided with a lever stopper hooking groove (232) on the outer periphery of the rotational direction at the same distance as the lever stopper (221) from the rotating axle (230*a*). The lever stopper (221) is attached to an elastic bar (222), which extends in the stopper forming groove (223) formed at the second terminal position assuring member (220), wherein the lever stopper includes a stopper (221*a*) hooked at the lever stopper hooking groove (232) when the lever member (230) rotates, and hooking release protrusions (221*b*), which extend from opposing sides of the female connector (200), at the further outer side of the outer periphery of the lever member (230). Accordingly, during the rotation of the lever member, the stopper (221*a*) of the lever stopper (221) elastically deforms on the outer periphery of the lever member (230) and then the stopper (22*a*) is hooked at the lever stopper hooking groove (232), thereby the lever member (230) remains fixed, and does not move.

Moreover, as described in the enlarged portion of FIG. 6, the stopper forming groove (223) is formed to be greater than the elastic bar (222) so that the elastic bar (222) having the lever stopper (221) attached thereto may be remotely spaced. The functions of such a stopper forming groove (223), elastic bar (222), and the hooking release protrusions (221*b*) will be described hereinafter together with the assembly process of the male connector (100) and the female connector (200), referring to FIGS. 8 and 9.

Figure 7:
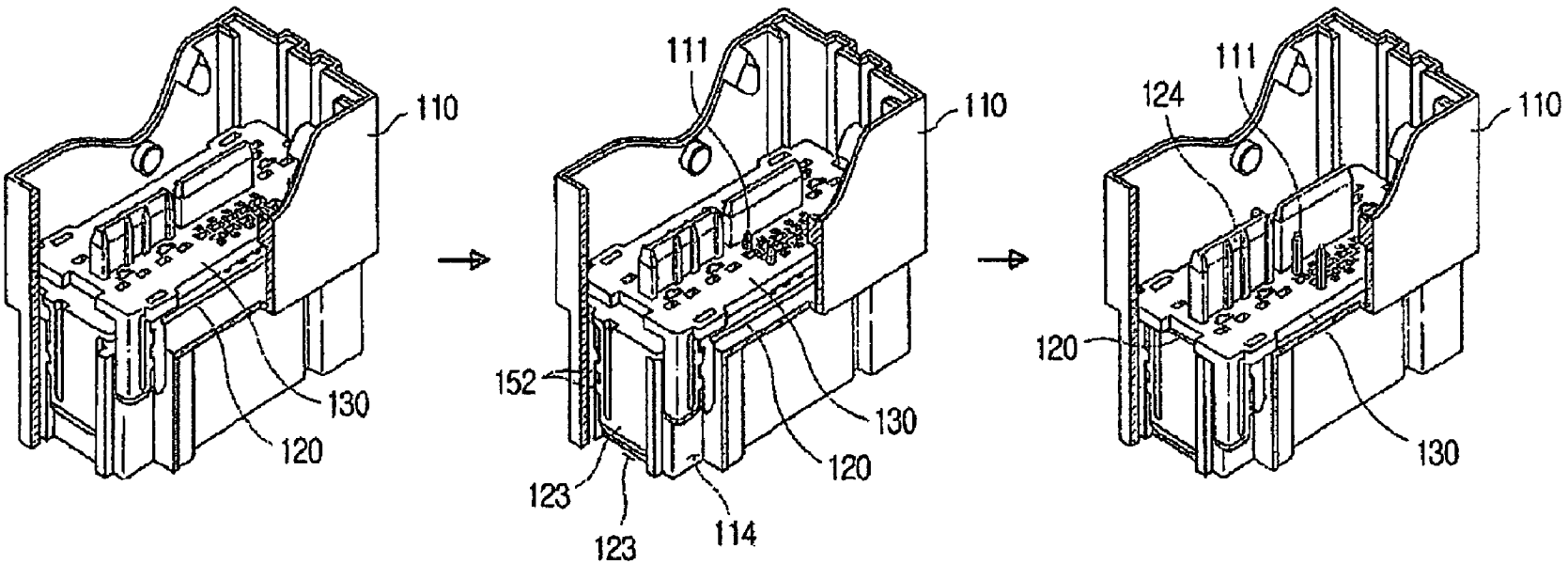
FIG. 7 illustrates an assembling process of the electrical connector according to the present invention.

Hereinafter, the assembly process of an electric connector and a connector assembly will be explained in detail, referring to FIGS. 7-9.

When the electric connector is used for a product having complicated structures and numerous wires, such as an automobile, etc., the automobile manufacturer alone cannot perform all the work such as producing connectors, working on wire harness, and applying them to products. In the aforementioned embodiments, two engaging protrusions and recess portions are complementarily engaged, or two engaging protrusions and receiving protrusions are complementarily engaged, and thus, it is configured that the terminal protecting plate is engaged with the terminal position assuring member, and then the terminal position assuring member is engaged with the housing, forming double engagements. That is, in the manufacturing process of the injection molding of the connector, the molded connector is completed as shown in the first drawing of FIG. 7. Afterwards, the molded connector is provided for the wire harness work with the housing (110), the terminal position assuring member (120), and the terminal protecting plate (130) being engaged at only one of each the protrusions and recess portions or receiving protrusions of the engaging elements. Since only one protrusion is engaged and the terminal position assuring member is not closely attached to the housing yet, the wire harness work can be done much easier with the molded connector. The position of the terminal is finalized after the terminals and wires are fixed by the wire harness work, and all of the second protrusion portions (114) of the housing (110) are inserted into the second recess portions (124) of the terminal position assuring member (120). Thus, the terminal position assuring member (120) and the housing (110) are closely attached to each other as shown in the second drawing of FIG. 7. It is supplied to the automobile assembly process under such a condition. The terminal protecting plate (130) protects the male terminal (111). After checking wire conditions and any defects in the automobile assembly process, the housing (110), the terminal position assuring member (120), and the terminal protecting plate (130) can be finally mounted to an automobile by completely engaging all engaging elements. As such, they are assembled in a proper state of engagement for each assembly step of the connector, which allows for efficient work performance.

Figure 8:
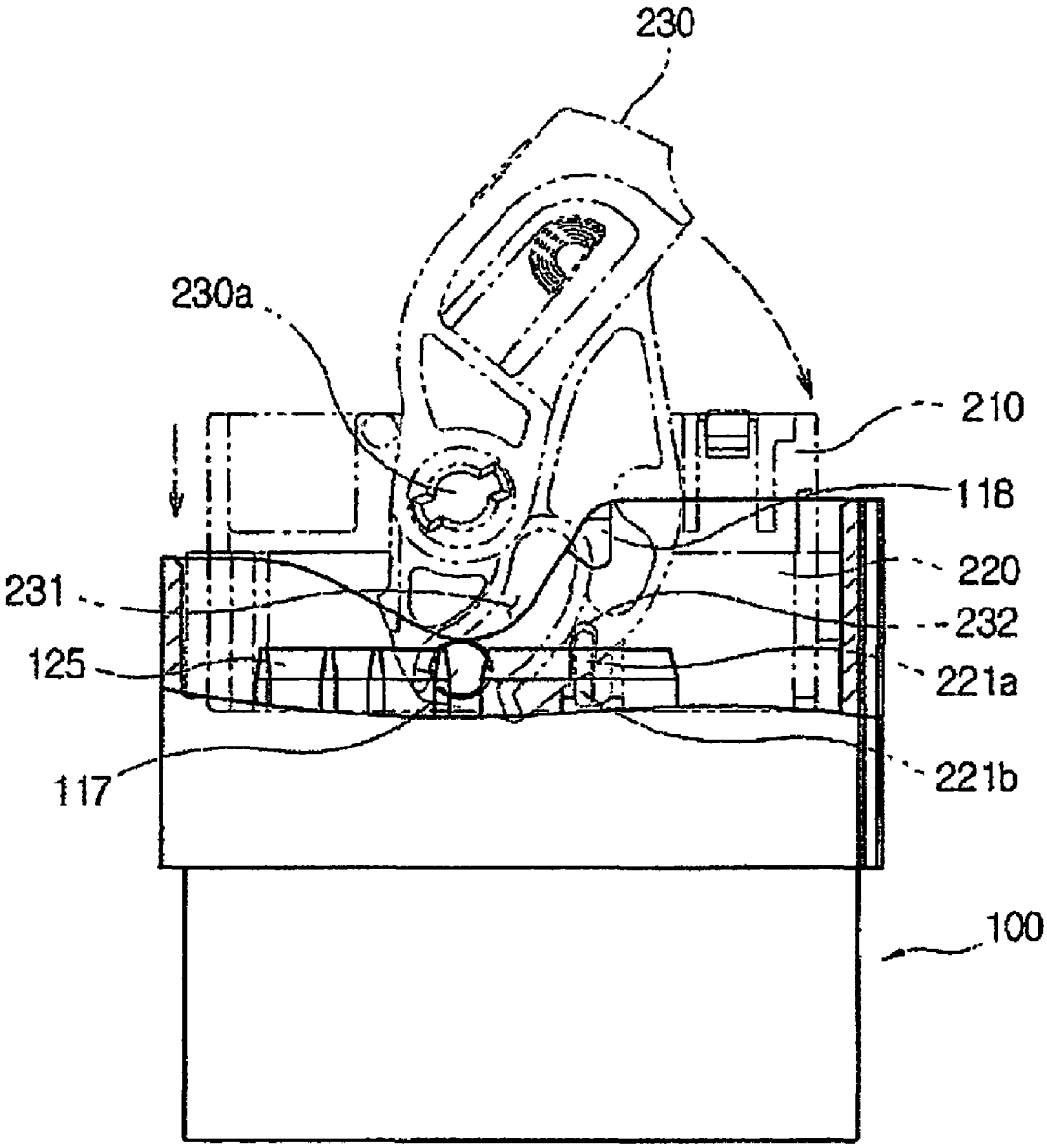
FIGS. 8 and 9 are cross sectional views in side elevation, which illustrate an assembling process of female and male connectors of the connector assembly according to the present invention.
Figure 9:
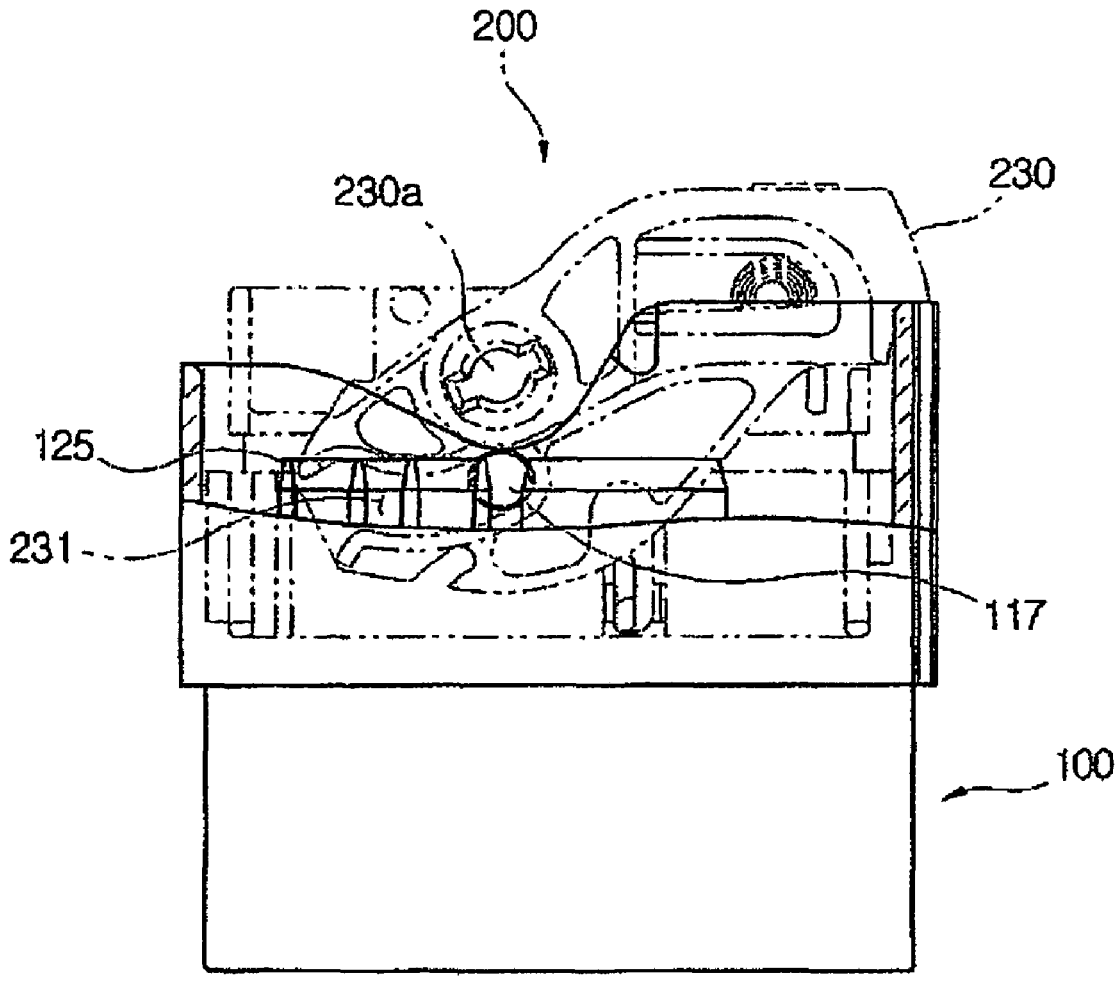

As shown in FIGS. 8 and 9, the connector receiving portion (116) is provided with a lever stopper pressing piece (118), and the engaging receiving groove (231) is in a circular arc shape bent in the reverse direction to the lever rotating direction. In order to assemble the male connector (100) and the female connector (200), the female connector (200) is inserted into the male receiving portion (116) of the male connector (100) by rotating and then fixing the lever member (230). Here, when the female connector (200) is slantingly inserted, the male terminal is prevented from being deformed by the kojiri protecting wall (125), so that the end of the male terminal (111) can be protected.

The engagement pins (117), provided in the connector receiving portion (116) of the male connector (100), are hooked at the entrance of the engagement pin receiving groove (231) of the lever member (230) of the female connector (200). At the same time, the lever stopper pressing piece (118) presses the hooking release protrusions (221*b*) of the lever stopper (221). Accordingly, the elastic bar (222) elastically deforms inwardly toward the stopper forming groove (223), while the stopper (221*a*) is remotely spaced and released from the lever stopper hooking groove (232) of the lever member (230). That is, in the state where the male connector (100) and the female connector (200) are arranged as shown in FIG. 8, the lever member (230) can rotate freely.

As the operator rotates the lever member (230) in the clockwise direction, the engagement pin (231) is guided by the engagement pin receiving groove (231), while the female connector (200) connected to the rotating axis (230*a*) moves toward the male connector (100) in a manner that the rotating axis (230*a*) of the lever member (230) moves toward the male connector (100). Thereafter, the female terminals of the female connector (200) are connected to the male terminals of the male connector (100) to complete the connector assembly.

Such a lever member (230) can reduce the engaging force to push the female connector (200) into the male connector (100) by using leverage, and thus, even in a small space where any tool can be hardly inserted therein when a connector is mounted inside an automobile, a connector assembly can be completed by employing only a minor engaging force to rotate the lever portion (230). Thus, the assembly becomes easy.

According to the present invention, each of the engaging elements of the connector housing, the terminal position assuring member, and the terminal protecting plate can be mutually engaged in a stepwise manner only as much as required during the steps of the assembly process, and thus the working effect may be enhanced.

Another functional effect of the present invention is that the bending or deformation of the male terminal end of the male connector caused by a female connector during assembly can be prevented by the kojiri protecting wall.

Another functional effect of the present invention is that the lever member can be easily operated during assembly by fixing and releasing the lever member by the features, such as the lever stopper, the lever stopper hooking groove, and the lever stopper pushing plate.

Another functional effect of the present invention is that in the connector housing even without elements for mounting or maintaining the terminal protecting plate, the terminal protecting plate can be engaged to the terminal position assuring member so that the volume of the connector housing reduces, which allows for the invention to be compact in terms of size and design.

The invention claimed is:

1. An electrical connector, comprising: a housing having a plurality of terminals and a number of terminal receiving holes for receiving and supporting the terminals therein; a terminal position assuring member mounted to the housing, the terminal position assuring member including a plurality of first terminal passing holes configured such that one end of the terminals pass therethrough; engaging means; and a terminal protecting plate mounted to the terminal position assuring member by the engaging means, the terminal protecting plate including second terminal passing holes aligned with the first terminal passing holes, wherein the engaging means comprises: a first engaging element disposed in the terminal protecting plate; and a second engaging element disposed in the terminal position assuring member and being complementarily engaged to the first engaging element, wherein the first engaging element comprises: a plurality of first engaging legs extending from the terminal protecting plate; and one or more first recess portions formed on the first engaging leg wherein the second engaging element comprises: a supporting leg; and one or more first protrusion portions laterally protruding from the supporting leg and being engaged to the first recess portion.

2. The electrical connector of claim 1, wherein the housing includes a third engaging element disposed at opposing sides of the housing, wherein the terminal position assuring member includes a fourth engaging element engaged to the third engaging element.

3. The electrical connector of claim 2, wherein the third engaging element comprises: a first insertion portion formed along a longitudinal direction of the terminal receiving hole; and one or more second protrusion portions protruding from an inner wall of the first insertion portion, wherein the fourth engaging element comprises:

a second engaging leg inserted into the first insertion portion; and one or more second recess portions formed on the second engaging leg and being elastically engaged to the second protrusion portion.

4. The electrical connector of claim 3, wherein the third engaging element further comprises second and third insertion portions formed along a longitudinal direction of the terminal receiving hole, wherein the second engaging element comprises a leg receiving portion inserted into the second insertion portion, wherein the first engaging element comprises: a third engaging leg engaged to the leg receiving portion; and a guide leg inserted into the third insertion portion.

5. The electrical connector of claim 1, wherein the terminal position assuring member further includes a preventing wall formed to be higher than the one end of the terminal, wherein the terminal protecting plate further includes a through hole, through which the preventing wall passes.

6. A connector assembly having a male connector and a female connector matable to each other, comprising:

the male connector comprising:

a male connector housing having a plurality of terminals, a plurality of male terminal receiving holes for receiving and supporting the terminals therein, a connector receiving portion formed at a side of the male connector housing, in which one ends of the male terminals are projected, for receiving the female connector, and engagement pins formed on inner opposite surfaces of the connector receiving portion;

a first terminal position assuring member mounted to the male connector housing, the first terminal position assuring member including a plurality of first terminal passing holes configured such that one end of the male terminals pass therethrough;

engaging means; and a terminal protecting plate mounted to the first terminal position assuring member by the engaging means, the terminal protecting plate including second terminal passing holes aligned with the first terminal passing holes, the female connector comprising:

a female connector housing insertable into the connector receiving portion, the female connector housing having a plurality of female terminals for connection to the male terminals and a plurality of female terminal receiving holes for receiving and supporting the female terminals therein;

a second terminal position assuring member mounted to an end portion of the female connector housing to be inserted into the connector receiving portion, the second terminal position assuring member having a hexahedral shape opened at a top side and having through holes aligned with the female terminal receiving holes at a bottom side; and a lever member pivotably mounted to the female connector housing and having a receiving groove for receiving the engagement pin during engagement of the connectors and applying force to the engagement pin by pivoting, the force being required to engage and separate the male connector and the female connector.

7. The connector assembly of claim 6, wherein the second terminal position assuring member includes a lever stopper for fixing the lever member with respect to the female connector housing.

8. An electrical connector, comprising: a housing having a plurality of terminals and a number of terminal receiving hole for receiving and supporting the terminals therein; a terminal position assuring member mounted to the housing, the terminal position assuring member including a plurality of first terminal passing holes configured such that one ends of the terminals pass therethrough; engaging means; and a terminal protecting plate mounted to the terminal position assuring member by the engaging means, the terminal protecting plate including second terminal passing holes aligned with the first terminal passing holes, wherein the engaging means comprises: a first engaging element disposed in the terminal protecting plate; and a second engaging element disposed in the terminal position assuring member and being complementarily engaged to the first engaging element, wherein the first engaging element comprises: a plurality of first engaging legs extending from the terminal protecting plate; and one or more first protrusion portions laterally protruding from the first engaging leg, wherein the second engaging element comprises: a supporting leg; and one or more first recess portions engaged to the first protrusion portion.

9. The electrical connector of claim 8, wherein the housing includes a third engaging element disposed at opposing sides of the housing, wherein the terminal position assuring member includes a fourth engaging element engaged to the third engaging element.

10. The electrical connector of claim 9, wherein the third engaging element comprises: a first insertion portion formed along a longitudinal direction of the terminal receiving hole; and one or more second protrusion portions protruding from an inner wall of the first insertion portion, wherein the fourth engaging element comprises:

a second engaging leg inserted into the first insertion portion; and one or more second recess portions formed on the second engaging leg and being elastically engaged to the second protrusion portion.

11. The electrical connector of claim 10, wherein the third engaging element further comprises second and third insertion portions formed along a longitudinal direction of the terminal receiving hole, wherein the second engaging element comprises a leg receiving portion inserted into the second insertion portion, wherein the first engaging element comprises: a third engaging leg engaged to the leg receiving portion; and a guide leg inserted into the third insertion portion.

12. The electrical connector of claim 8, wherein the terminal position assuring member further includes a preventing wall formed to be higher than the one end of the terminal, wherein the terminal protecting plate further includes a through hole, through which the preventing wall passes.

13. An electrical connector, comprising: a housing having a plurality of terminals and a number of terminal receiving hole for receiving and supporting the terminals therein; a terminal position assuring member mounted to the housing, the terminal position assuring member including a plurality of first terminal passing holes configured such that one ends of the terminals pass therethrough; engaging means; and a terminal protecting plate mounted to the terminal position assuring member by the engaging means, the terminal protecting plate including second terminal passing holes aligned with the first terminal passing holes, wherein the engaging means comprises: a first engaging element disposed in the terminal protecting plate; and a second engaging element disposed in the terminal position assuring member and being complementarily engaged to the first engaging element, wherein the first engaging element and the second engaging element are elastically engaged to each other.

14. The electrical connector of claim 13, wherein the housing includes a third engaging element disposed at opposing sides of the housing, wherein the terminal position assuring member includes a fourth engaging element engaged to the third engaging element.

15. The electrical connector of claim 14, wherein the third engaging element comprises: a first insertion portion formed along a longitudinal direction of the terminal receiving hole; and one or more second protrusion portions protruding from an inner wall of the first insertion portion, wherein the fourth engaging element comprises:

a second engaging leg inserted into the first insertion portion; and one or more second recess portions formed on the second engaging leg and being elastically engaged to the second protrusion portion.

16. The electrical connector of claim 15, wherein the third engaging element further comprises second and third insertion portions formed along a longitudinal direction of the terminal receiving hole, wherein the second engaging element comprises a leg receiving portion inserted into the second insertion portion, wherein the first engaging element comprises: a third engaging leg engaged to the leg receiving portion; and a guide leg inserted into the third insertion portion.

17. The electrical connector of claim 13, wherein the terminal position assuring member further includes a preventing wall formed to be higher than the one end of the terminal, wherein the terminal protecting plate further includes a through hole, through which the preventing wall passes.

18. An electrical connector, comprising: a housing having a plurality of terminals and a number of terminal receiving hole for receiving and supporting the terminals therein; a terminal position assuring member mounted to the housing, the terminal position assuring member including a plurality of first terminal passing holes configured such that one ends of the terminals pass therethrough; engaging means; and a terminal protecting plate mounted to the terminal position assuring member by the engaging means, the terminal protecting plate including second terminal passing holes aligned with the first terminal passing holes, wherein the engaging means comprises: a first engaging element disposed in the terminal protecting plate; and a second engaging element disposed in the terminal position assuring member and being complementarily engaged to the first engaging element, wherein the housing includes a third engaging element disposed at opposing sides of the housing, wherein the terminal position assuring member includes a fourth engaging element engaged to the third engaging element, wherein the third engaging element comprises: a first insertion portion formed along a longitudinal direction of the terminal receiving hole; and one or more second protrusion portions protruding from an inner wall of the first insertion portion, wherein the fourth engaging element comprises: a second engaging leg inserted into the first insertion portion; and one or more second recess portions formed on the second engaging leg and being elastically engaged to the second protrusion portion.

19. The electrical connector of claim 18, wherein the third engaging element further comprises second and third insertion portions formed along a longitudinal direction of the terminal receiving hole, wherein the second engaging element comprises a leg receiving portion inserted into the second insertion portion, wherein the first engaging element comprises: a third engaging leg engaged to the leg receiving portion; and a guide leg inserted into the third insertion portion.

20. The electrical connector of claim 18, wherein the terminal position assuring member further includes a preventing wall formed to be higher than the one end of the terminal, wherein the terminal protecting plate further includes a through hole, through which the preventing wall passes.

* * * * *